US009637211B2

(12) United States Patent
Brower

(10) Patent No.: US 9,637,211 B2
(45) Date of Patent: May 2, 2017

(54) PROPULSION SYSTEM HAVING COUNTER-ROTATING IMPELLERS

(71) Applicant: David R. Brower, Belton, SC (US)

(72) Inventor: David R. Brower, Belton, SC (US)

(73) Assignee: Palmetto Propulsion, LLC, Belton, SC (US)

( * ) Notice: Subject to any disclaimer, the term of this patent is extended or adjusted under 35 U.S.C. 154(b) by 0 days.

(21) Appl. No.: 14/861,011

(22) Filed: Sep. 22, 2015

(65) Prior Publication Data

US 2016/0083062 A1 Mar. 24, 2016

Related U.S. Application Data

(60) Provisional application No. 62/053,854, filed on Sep. 23, 2014.

(51) Int. Cl.

| | |
|---|---|
| ***B63H 5/10*** | (2006.01) |
| ***B63H 5/14*** | (2006.01) |
| ***B63H 1/04*** | (2006.01) |

(52) U.S. Cl.

CPC ..... *B63H 5/14* (2013.01); *B63H 1/04* (2013.01)

(58) Field of Classification Search

CPC ..... B63H 2011/085; B63H 2011/087; B63H 5/14; B63H 1/04

See application file for complete search history.

(56) References Cited

U.S. PATENT DOCUMENTS

| | | | | | |
|---|---|---|---|---|---|
| 3,017,848 | A * | 1/1962 | Bishop | B63H 11/08 | 415/100 |
| 3,276,415 | A * | 10/1966 | Laing | B63H 1/04 | 114/282 |
| 4,738,584 | A * | 4/1988 | Price | B01F 7/00733 | 415/203 |
| 5,711,657 | A * | 1/1998 | Hoffmeier | F04D 29/247 | 415/141 |
| 7,632,061 | B2 * | 12/2009 | Neeb | B63H 11/08 | 415/144 |
| 2009/0163091 | A1 * | 6/2009 | Shiomi | B63H 20/34 | 440/76 |
| 2011/0275254 | A1 * | 11/2011 | Rolla | B63H 23/30 | 440/1 |

* cited by examiner

*Primary Examiner* — Stephen Avila
(74) *Attorney, Agent, or Firm* — Faegre Baker Daniels LLP

(57) ABSTRACT

A marine propulsion system includes a housing configured to be coupled to, or within, a marine vessel hull. At least one pair of counter-rotating impellers is disposed within the housing such that the rotation occurs in a plane generally parallel to the surface of the water. A moveable output nozzle is coupled to the rear portion of the housing and can move to facilitate controlling the direction of travel of the vessel.

20 Claims, 10 Drawing Sheets

PROPULSION SYSTEM HAVING COUNTER-ROTATING IMPELLERS

CROSS REFERENCE TO RELATED APPLICATION

This application claims priority under 35 U.S.C. §119(e) to U.S. Provisional application Ser. No. 62/053,854, filed Sep. 23, 2014, the entire disclosure of which is hereby expressly incorporated herein by reference.

FIELD OF THE DISCLOSURE

The present disclosure relates to marine propulsion systems and, more specifically, to a "final drive" arrangement having counter-rotating impellers, that can be coupled to many types of existing propulsion arrangements, including outboards, sterndrives, pod drives, inboards and/or the like.

BACKGROUND

Existing marine propulsion systems typically utilize propellers (e.g., in the case of outboards, inboards, sterndrives, and pod drives) or impellers (e.g., in the case of jet drives) which rotate in a direction generally perpendicular to the surface of the water (or keel of the vessel). In other words, the rotation axes of known propellers or impellers extend along a direction generally parallel to the surface of the water. These systems may have certain drawbacks, including high drag levels due to excessive equipment surface below the waterline, high levels of cavitation due to the inefficiency of the direction of rotation in comparison to the direction of water flow, safety related issues due to rotating blades exposed in open water, and/or the like.

Many conventional marine propulsion systems also include a direct connection between the engine or motor and the drive unit, thereby locking the propeller speed directly in relation to the input speed. This reduces the efficiency of the system under certain conditions.

SUMMARY

Embodiments of the present disclosure include a marine propulsion system that is adaptable to many existing powerplant designs, facilitates increased safety as a result of no exposed moving blades, facilitates improved propulsion efficiency through lower case drag and improved water flow arrangement through the propulsor, facilitates the ability to change the ratio of input speed to impeller speed, and facilitates improved vessel control as a result of control surfaces and outlet nozzle configurations.

Embodiments include a marine propulsion system having an input shaft attached directly to an outboard, sterndrive, pod drive or inboard/transfer case output shaft. In embodiments, the propulsion system is configured to replace the lower unit, or drive case, on existing outboards, sterndrives, and pod drives, and may be directly mounted to an inboard vessel when driven by a 90 degree drive case connected to the inboard engine/transmission. The input shaft may be directly connected to an idler or drive gear, which is used to drive a first impeller gear. The first impeller gear drives a second impeller gear, thereby connecting the impellers in a counter-rotation configuration. The input gears may be designed such that the impeller rotation of the impellers draws water through the impellers and towards the aft (rear) portion of the vessel and into an output nozzle. In embodiments, the input shaft may be directly connected to a transmission device, such as a hydro-mechanical transmission or a constant velocity transmission, which is connected to one of the impeller gears.

Because the impellers may be constantly in motion as long as the engine or motor are operating, water pressure is available near the impeller output area which can be utilized to cool the engine in the case of an internal combustion engine. This may eliminate a need for external water pumps which may be prone to premature wear and failure. Additionally, the impellers may be arranged in parallel with the water surface, thereby mitigating drag on the propulsion system housing. The housing may be designed such that it provides lift to the vessel as well as control surfaces which assist in steering and boat trim.

A marine propulsion system includes two counter-rotating impellers arranged in a fashion generally parallel to the surface of the water and driven by two counter-rotating drive gears which are attached to a drive shaft through means of either a drive gear directly attached to the input drive shaft from the engine or through a transmission device which may change the drive ratio between the engine and the propulsion system gears. A housing designed to envelop the impellers, may provide water ingress and egress paths, including inlet ports which prevent accidental access to the impeller region, and a movable output nozzle on the outlet of the housing which provides steering control, trim control, and thrust reversal. The housing may also provide a path for exhaust gas flow from an engine under the water level, provide a water flow path for cooling water that is transferred from the impellers to the engine, and/or provide a hydro-dynamic surface and control surface to assist with the control of the vessel. In embodiments, the propulsion system is highly adaptable and may be utilized in conjunction with outboard, sterndrive, and/or pod drive propulsion arrangements, or may be integrated directly into the hull of the vessel and driven similar to an inboard propulsion arrangement, e.g., by using a 90 degree drive gear housing inside the vessel.

In one form thereof, the present disclosure provides a marine propulsion system, including a housing configured to be coupled to a marine vessel; and a pair of counter-rotating impellers that rotate generally parallel to the surface of the water to provide thrust to the vessel.

In another form thereof, the present disclosure provides a marine vessel, including a hull; and a marine propulsion system, operatively coupled to the hull, and including a pair of counter-rotating impellers that rotate generally parallel to the surface of the water to provide thrust to the vessel.

In a further form thereof, the present disclosure provides a marine propulsion system, including a housing configured to be coupled to a marine vessel; a pair of counter-rotating impellers that rotate generally parallel to the surface of the water to provide thrust to the vessel; and an output nozzle, the output nozzle having an opening out of which water is pushed by the impellers to provide the thrust, wherein the output nozzle is moveable, thereby facilitating steering control and/or vessel trim control.

Figure 1:
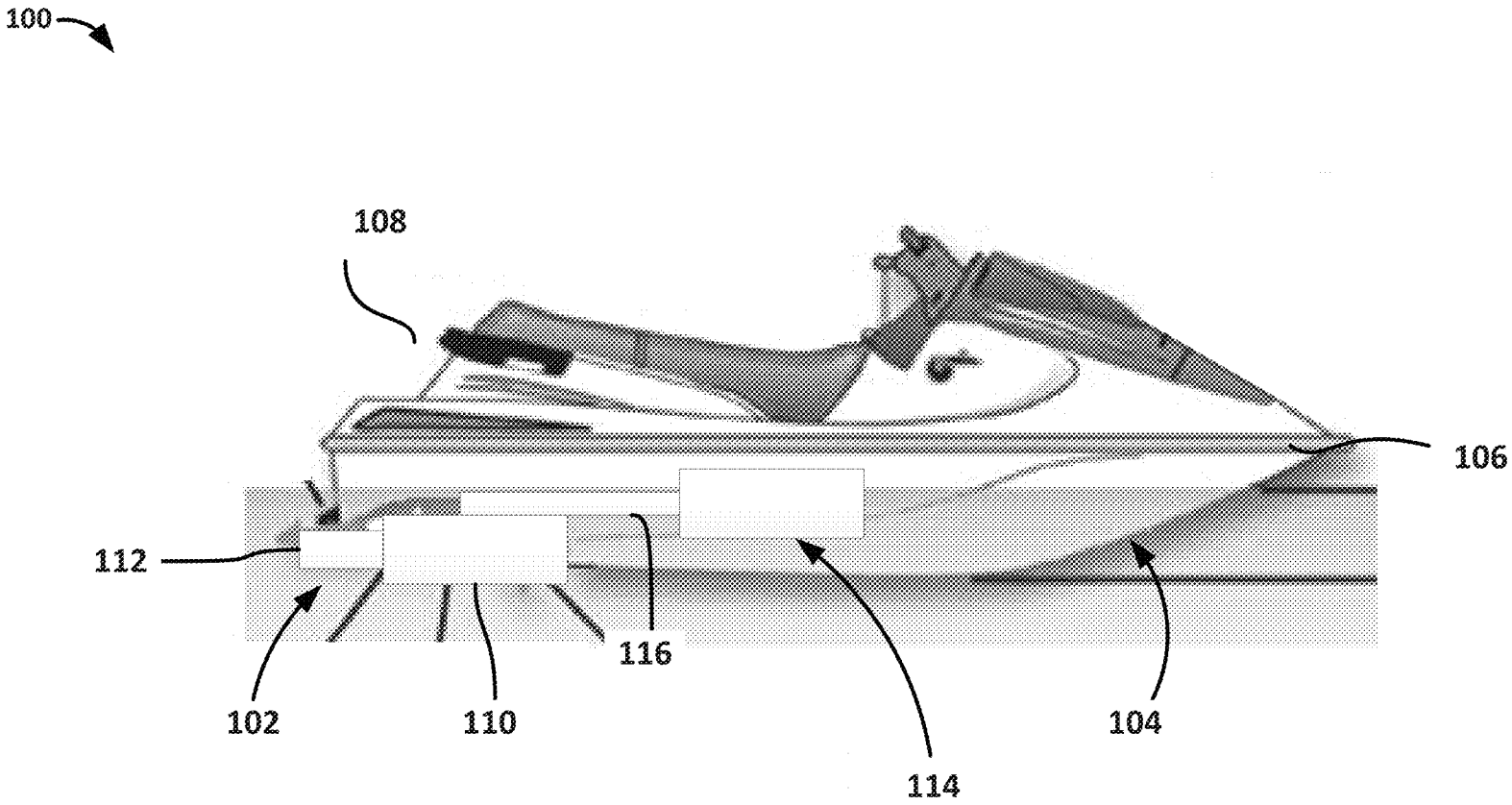
FIG. 1 is a schematic diagram depicting a marine vessel with a marine propulsion system in accordance with embodiments of the disclosure.

While the present disclosure is amenable to various modifications and alternative forms, specific embodiments have been shown by way of example in the drawings and are described in detail below. The present disclosure, however, is not limited to the particular embodiments described. On the contrary, the present disclosure is intended to cover all modifications, equivalents, and alternatives falling within the ambit of the present disclosure as defined by the appended claims.

DETAILED DESCRIPTION

FIG. 1 a schematic diagram depicting a marine vessel 100 with a marine propulsion system 102 in accordance with embodiments of the disclosure. The vessel 100 may include any type of vehicle configured for traveling on and/or in a body of water. For example, the vessel 100 may be a personal watercraft, a fishing boat, a freighter, a passenger ship, a tug boat, a submarine, and/or the like. As shown in FIG. 1, the vessel 100 includes a hull 104 having a bow 106 and a stern 108. The marine propulsion system 102 may be coupled to and/or disposed within (or partially within) the hull 104 at or near the bow 106 or the stern 108. In embodiments, the vessel 100 may include more than one marine propulsion system 102. For example, the vessel 100 may include a first marine propulsion system 102 at or near the bow 106 and a second marine propulsion system 102 at or near the stern 108. In this manner, multiple marine propulsion systems 102 may facilitate greater control over the direction of travel of the vessel 100.

As shown in FIG. 1, the marine propulsion system 102 may include a housing 110 and an output nozzle 112. In embodiments, the housing 110 may be configured to be coupled to the vessel 100 such as, for example, by being coupled to the hull 104, disposed at least partially within the hull 104, and/or the like. The housing 110 may be removably coupled to the hull 104, fixedly coupled to the hull 104, and/or coupled to the hull 104 in such a manner as to enable the housing 104 to move (e.g., rotate, pivot, etc.) in response to actuation by a control mechanism. The output nozzle 112 may be moveable so as to facilitate steering the vessel 100. The propulsion system 102 may be powered by a prime mover such as engine 114 or an electric motor, for example, which is connected to the propulsion system 102 by a transmission 116. The transmission 116 may be any type of transmission such as, for example, a standard gear train, a belt drive, a continuous variable transmission (CVT), and/or the like.

According to embodiments, the marine propulsion system 102 includes two counter-rotating impellers arranged in a fashion generally parallel to the surface of the water. In other words, the rotation axes of the impellers extend in directions substantially perpendicular to the surface of the water. The propulsion system 102 may be configured to be highly adaptable and may be utilized in conjunction with outboard, sterndrive, and/or pod drive propulsion arrangements and/or may be integrated directly into the hull 104 of the vessel 100 and driven similar to an inboard propulsion arrangement, for example, by using a 90 degree drive gear housing inside the vessel 100. The housing 110, which may be designed to surround or envelop the impellers, provides water ingress and egress paths. The output nozzle 112 may be moveable, thereby facilitating both steering and trim control. Additionally, the output nozzle 112 may provide a path for exhaust gas flow from an engine under the water level, provide a water flow path for cooling water that is transferred from the impellers to the engine, and/or provide a hydro-dynamic surface and control surfaces to assist the planning and control of the vessel.

FIGS. 2-7 depict an illustrative marine propulsion system 200 in accordance with embodiments of the disclosure. For example, the marine propulsion system 200 may be, or include, the marine propulsion system 102 depicted in FIG. 1 and may be configured to be coupled to a vessel (e.g., the vessel 100 depicted in FIG. 1). As shown in FIGS. 2-7, the marine propulsion system 200 includes a housing 202 and an output nozzle 204 coupled to a rear portion 206 of the housing 202. The output nozzle 204 may be moveably (e.g., pivotably) coupled to the housing 202. In this manner, the output nozzle 204 may be used for steering and/or other positional control of a vessel to which it is attached. One or more winglets or other features (not shown) may be disposed on the outside of the output nozzle 204 to further achieve hydrodynamic objectives.

The housing 202 may enclose a chamber 205, and generally includes an upper surface 208, a generally parallel and opposite-facing lower surface 210, a front portion 212, and the rear portion 206. The upper surface 208 may include attachment features (not shown) for coupling the housing 202 to a hull of a vessel, and such, attachment features may be included on other portions of the housing 202 such as, for example, for coupling the housing 202 within a portion of a hull. Control surfaces may be disposed on the outside of other portions of the housing 202. In embodiments, for example, one or more winglets may be disposed on each side of the housing 202 at the front portion 212 and/or the rear portion 206. These control surfaces may facilitate improved steering under off-throttle conditions.

Figure 2:
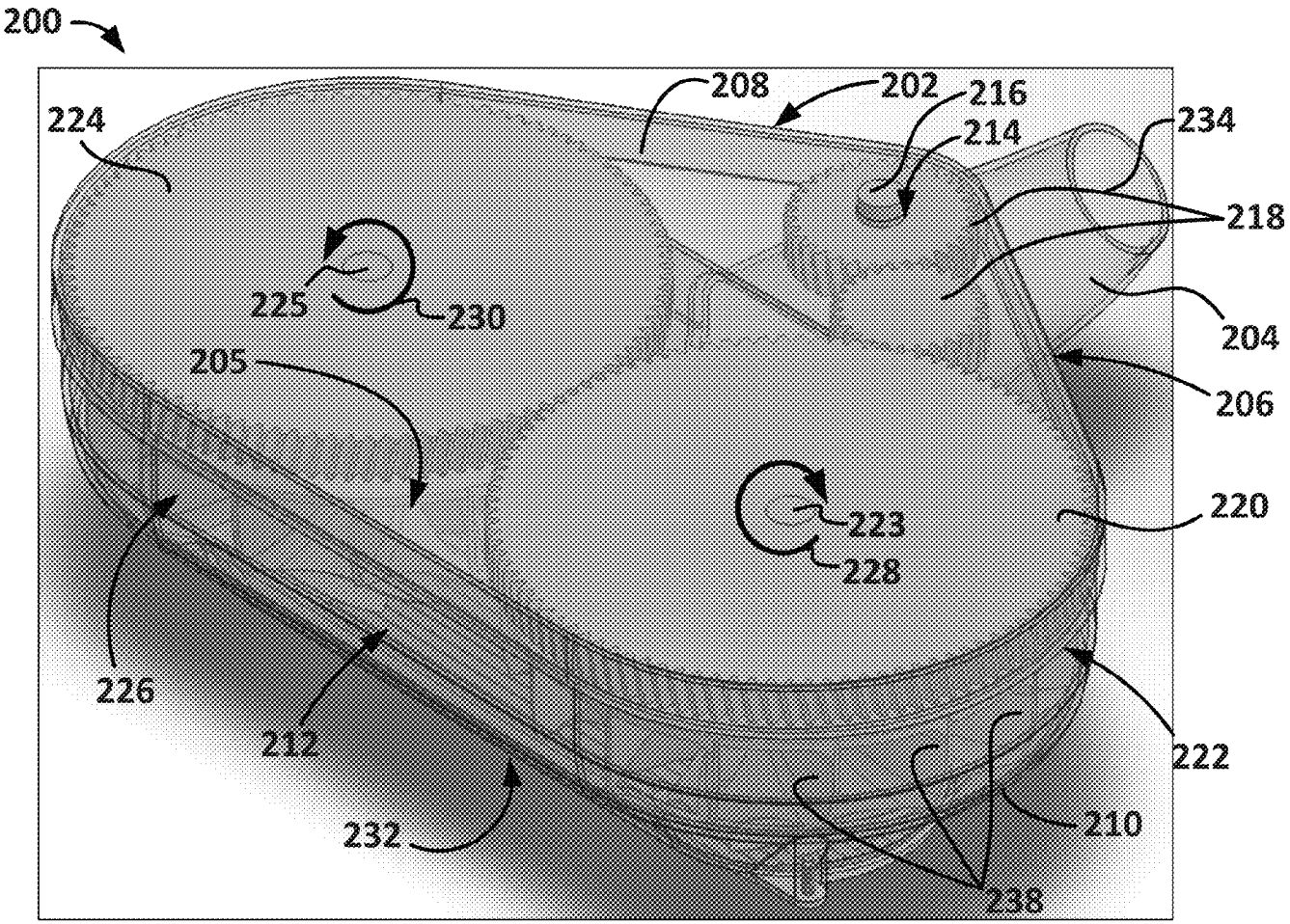
FIG. 2 is a partially-transparent upper perspective view of a marine propulsion system in accordance with an exemplary first embodiment of the present disclosure.
Figure 4:
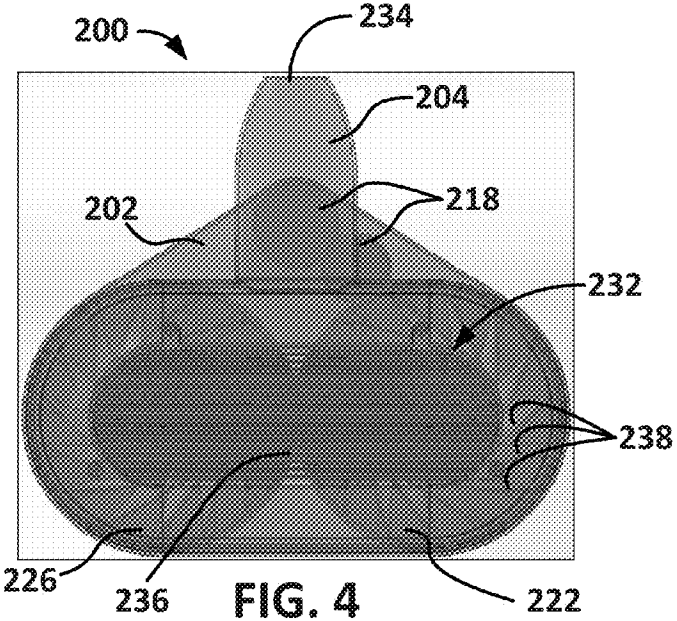
FIG. 4 is a partially-transparent bottom view of the marine propulsion system depicted in FIGS. 2 and 3.
Figure 3:
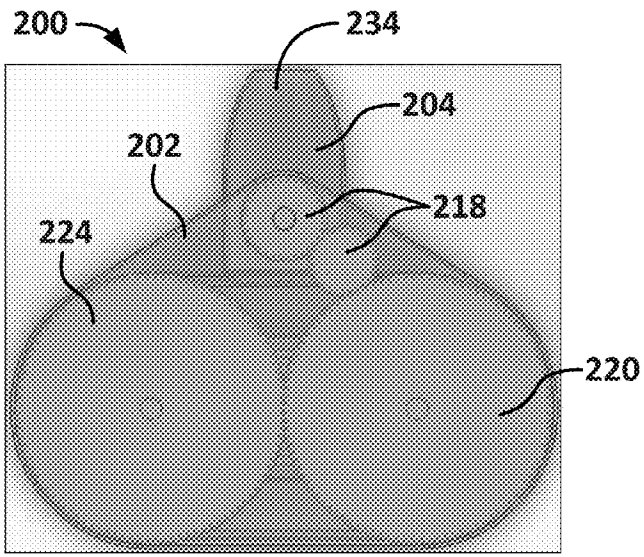
FIG. 3 is a partially-transparent top view of the marine propulsion system depicted in FIG. 2.
Figure 5:
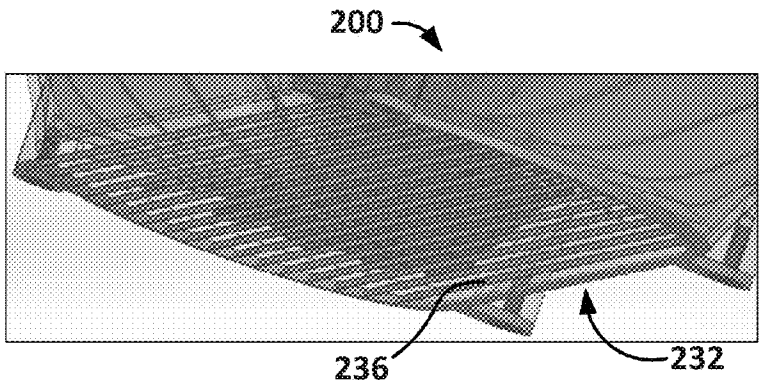
FIG. 5 is a lower perspective view of a portion of the marine propulsion system depicted in FIGS. 2-4.
Figure 6:
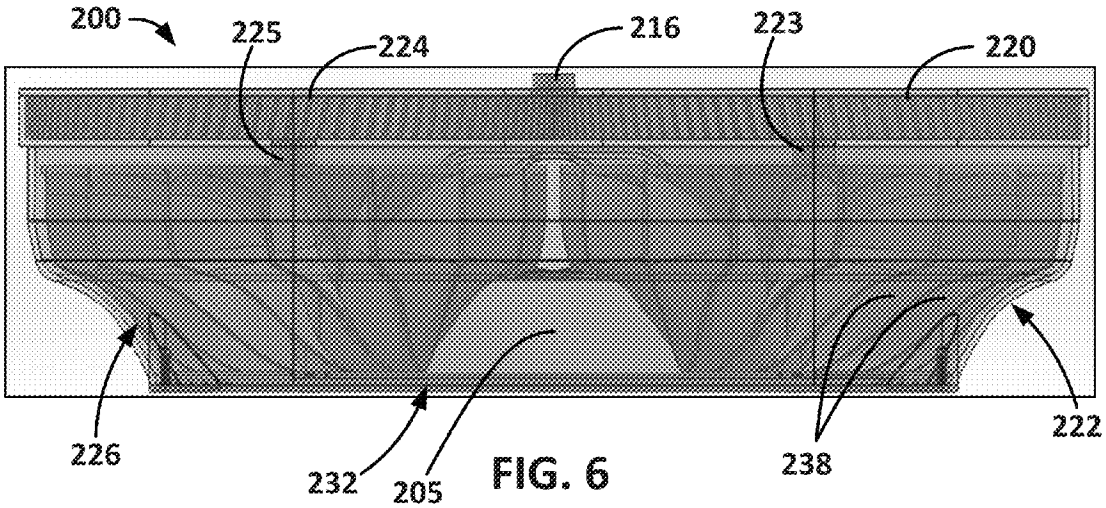
FIG. 6 is a partially-transparent front view of the marine propulsion system depicted in FIGS. 2-5.

As shown in FIG. 2, the upper surface 208 of the housing 202 may include an aperture 214 through which a drive shaft 216 may pass. As shown in FIG. 2, the transmission interface mechanism 216 may be coupled to one or more drive gears 218, which may engage a first impeller gear 220 that is coupled to a first impeller 222 via a gear shaft 223. The first impeller gear 220 may also be configured to engage a second impeller gear 224 that is coupled to a second impeller 226 via a gear shaft 225. In this manner, the first impeller 222 may be configured to rotate in a clockwise direction 228, which causes the second impeller 226 to rotate in a counterclockwise direction 230. The counter-rotating impellers 222 and 224 pull water in through an input port 232 disposed in the lower surface 210 of the housing 202 and push water out of the nozzle 204, through an opening 234 disposed therein. A grate 236 (or other protective covering such as, for example, a screen) may be disposed over the input port 232 to prevent objects from entering the chamber 205 and causing damage to, and/or being damaged by, the impellers 222 and 226 and/or other parts within the housing 202.

In embodiments, the housing 202 may include two input ports 232 such that a first input port 232 is arranged to provide water input to a first impeller 222 and a second input port 232 is arranged to provide water input to a second impeller 226. Any number of desired input ports may be disposed within the housing at any number of different positions. Additionally, the input port 232 may be configured according to any number of different shapes and may, in embodiments, be configured so as to increase the flow of water, decrease the flow of water, focus the flow of water, and/or the like. In embodiments, the input port 232 may include an adjustable feature configured to enable a user and/or control system to adjust the profile of the input port 232.

Figure 7:
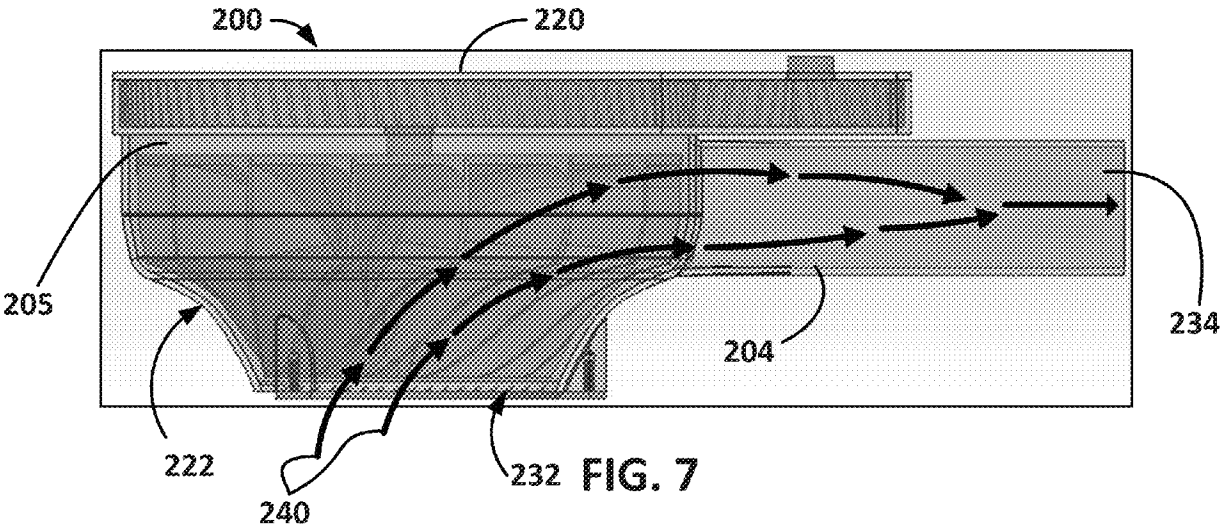
FIG. 7 is a partially-transparent side view of the marine propulsion system depicted in FIGS. 2-6.

Each of the impellers 222 and 226 may include a number of blades 238 configured such that as the impeller rotates, water is moved from the input port 232 toward the output nozzle 204, e.g., along an illustrative flow path generally indicated at 240, shown in FIG. 7. The impellers 222 and 226 (and blades 238) may be configured according to any number of centrifugal impeller designs. Additionally, in embodiments, the blades 238 may be configured to optimize propulsion in view of various factors such as, for example, vessel weight, vessel configuration, water depth, average water temperatures, cavitation thresholds, and/or the like.

FIGS. 8-13 depict another illustrative marine propulsion system 300 in accordance with embodiments of the disclosure. The marine propulsion system 300 includes generally similar features and components as those in the marine propulsion system 200 depicted in FIGS. 2-7, with the exception of the design of the impellers 302 and 304 and the location of the input port 306. As shown in FIGS. 8-13, the impellers 302 and 304 may be designed to be similar to Pelton wheels, having a shorter profile and blades 308 designed for pushing water in a more linear direction 310, from the front 312 of the system 300 to the rear 314 of the system 300.

For example, the marine propulsion system 300 may be, or include, the marine propulsion system 102 depicted in FIG. 1 and may be configured to be coupled to a vessel (e.g., the vessel 100 depicted in FIG. 1). As shown in FIGS. 8-13, the marine propulsion system 300 includes a housing 316 and an output nozzle 318 coupled to the rear portion 314 of the housing 316. The output nozzle 318 may be moveably (e.g., pivotably) coupled to the housing 316. In this manner, the output nozzle 318 may be used for steering and/or other positional control of a vessel to which it is attached. One or more winglets or other features may be disposed on the outside of the output nozzle 318 to further achieve hydrodynamic objectives.

Figure 8:
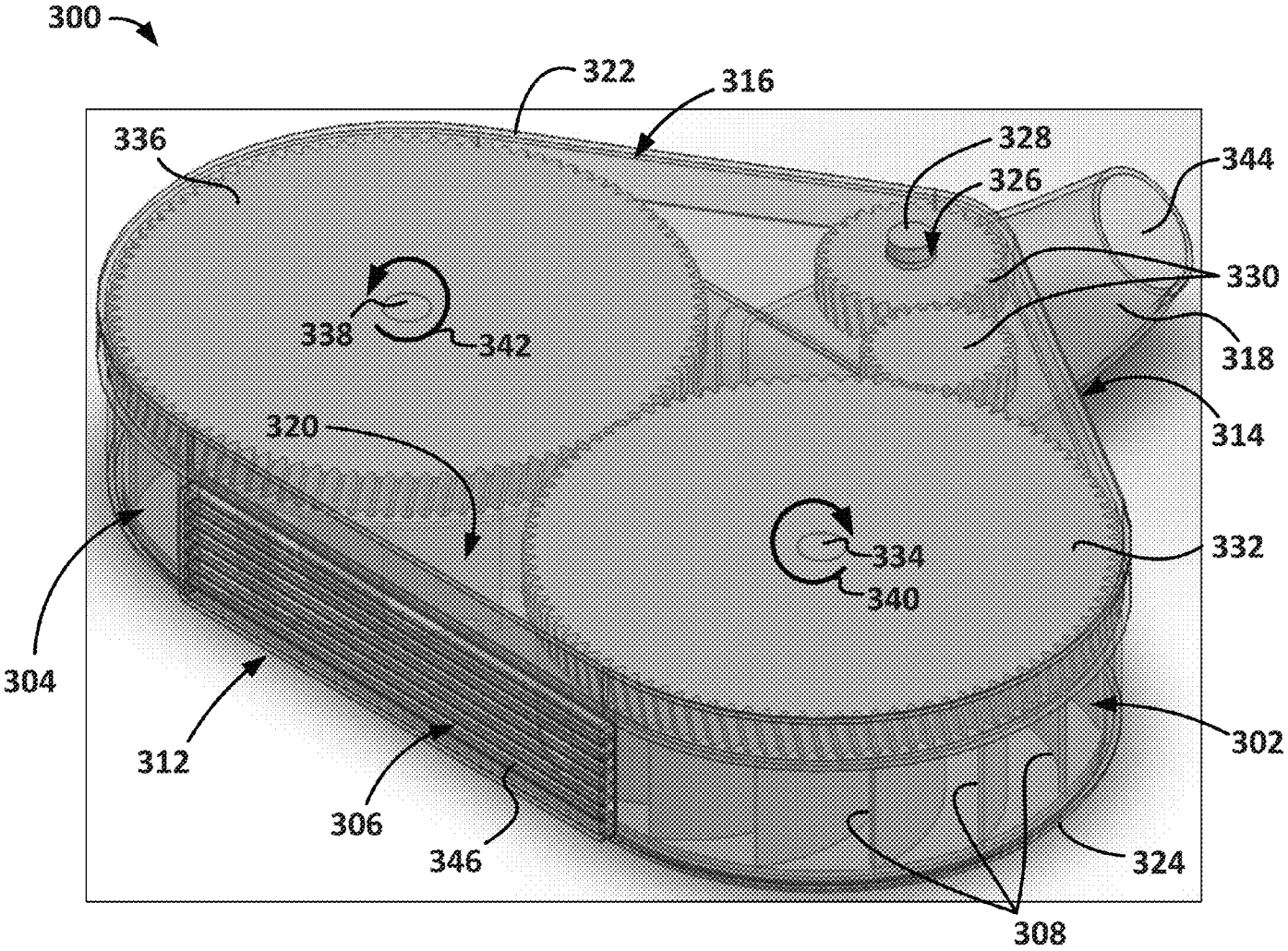
FIG. 8 is a partially-transparent upper perspective view of another marine propulsion system in accordance with an exemplary second embodiment of the present disclosure.
Figure 10:
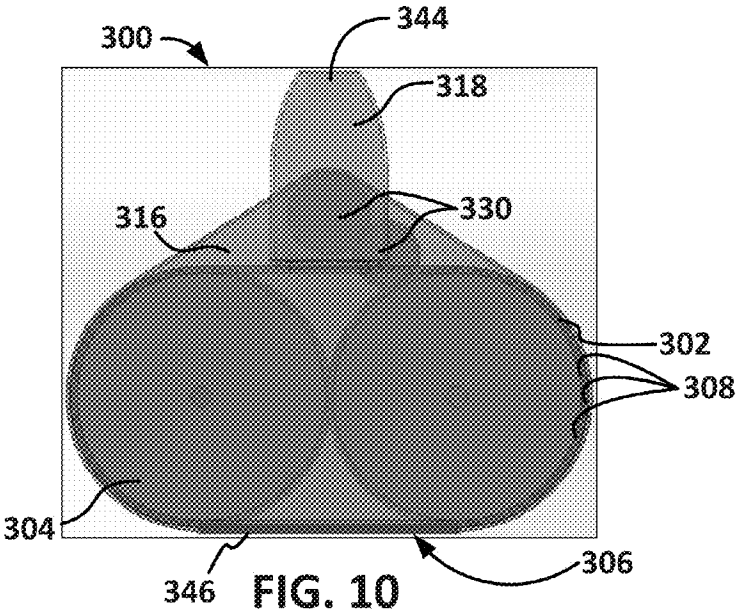
FIG. 10 is a partially-transparent bottom view of the marine propulsion system depicted in FIGS. 8 and 9.
Figure 9:
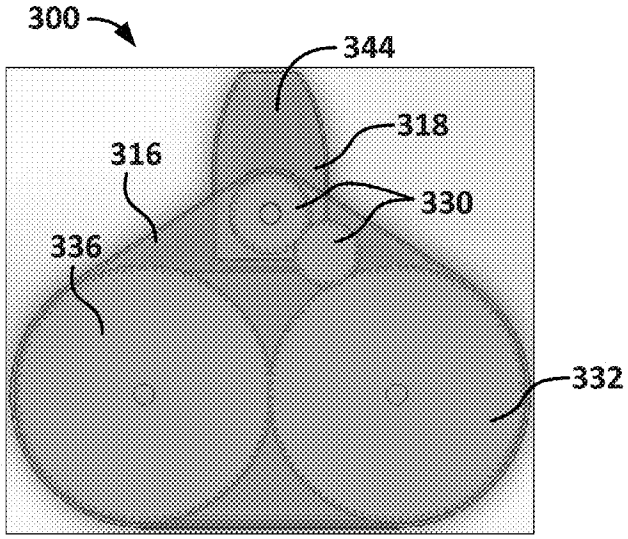
FIG. 9 is a partially-transparent top view of the marine propulsion system depicted in FIG. 8.
Figure 11:
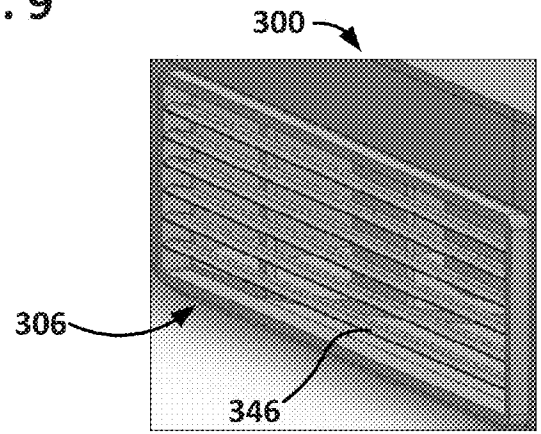
FIG. 11 is a front perspective view of a portion of the marine propulsion system depicted in FIGS. 8-10.
Figure 12:
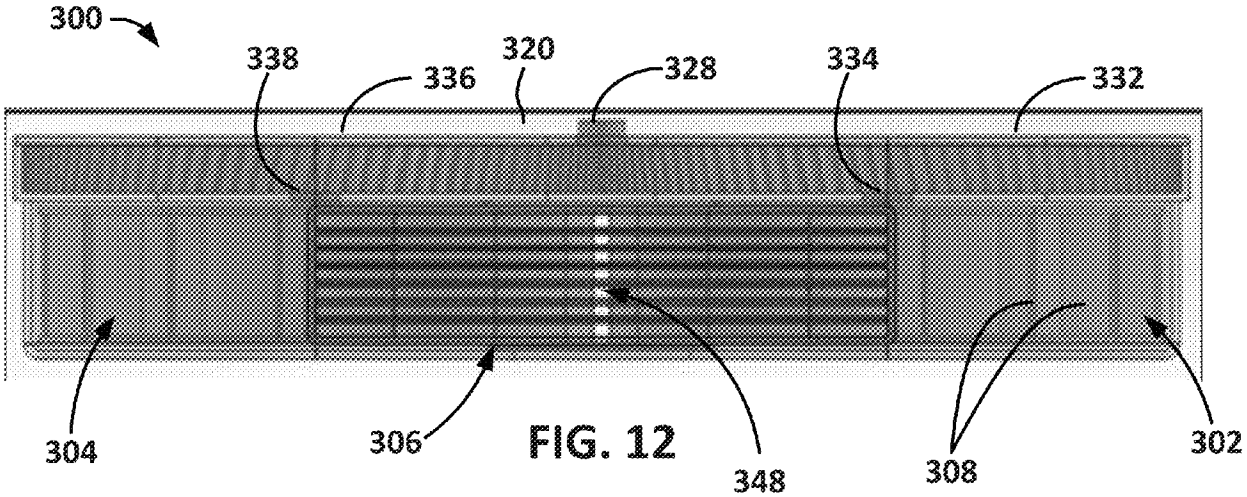
FIG. 12 is a partially-transparent front view of the marine propulsion system depicted in FIGS. 8-11 in accordance with embodiments of the present disclosure.
Figure 13:
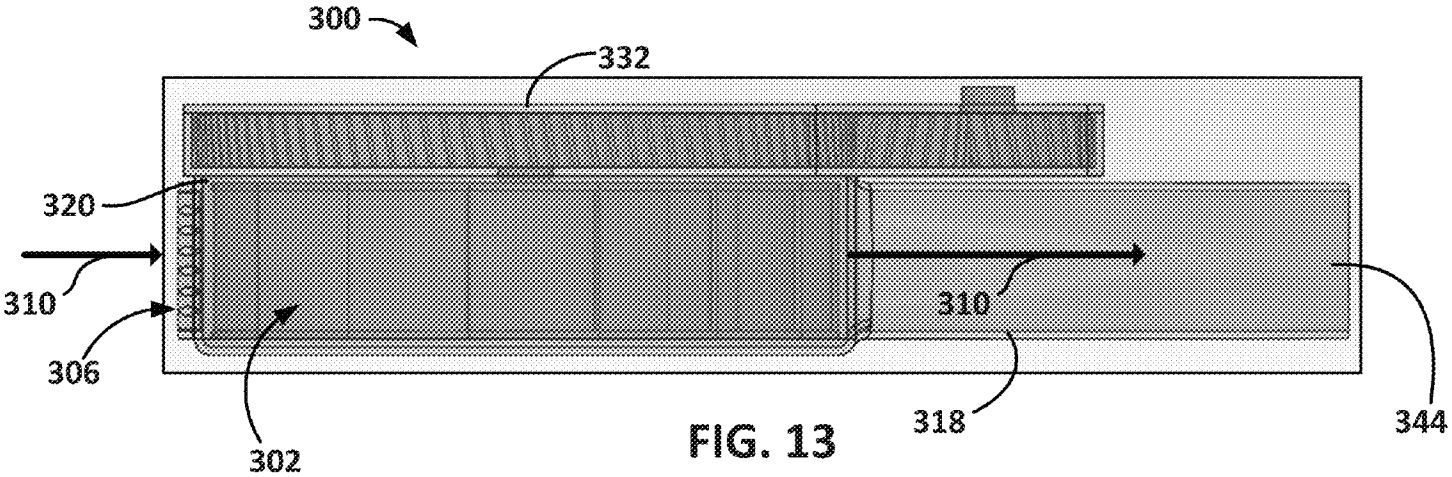
FIG. 13 is a partially-transparent side view of the marine propulsion system depicted in FIGS. 8-12.

The housing 316 may enclose a chamber 320, and generally includes an upper surface 322, a generally parallel and opposite-facing lower surface 324, the front portion 312, and the rear portion 314. The upper surface 322 may include attachment features (not shown) for coupling the housing 316 to a hull of a vessel. In embodiments, attachment features may be included on other portions of the housing 316 such as, for example, for coupling the housing 316 within a portion of a hull. As shown in FIG. 8, the upper surface 322 of the housing 316 may include an aperture 326 through which a drive shaft 328 may pass. As shown in FIG. 8, the drive shaft 328 may be coupled to one or more drive gears 330, which may engage a first impeller gear 332 that is coupled to the first impeller 302 via a gear shaft 334. The first impeller gear 332 may also be configured to engage a second impeller gear 336 that is coupled to the second impeller 304 via a gear shaft 338.

In this manner, the first impeller 302 may be configured to rotate in a clockwise direction 340, which causes the second impeller 304 to rotate in a counterclockwise direction 342. The counter-rotating impellers 302 and 304 pull water in through the input port 306 disposed on the front portion 312 of the housing 316 and push water out of the nozzle 318, through an opening 344 disposed therein. A grate 346 (or other protective covering such as, for example, a screen) may be disposed over the input port 306 to prevent objects from entering the chamber 320 and causing damage to, and/or being damaged by, the impellers 302 and 304 and/or other parts within the housing 316.

Each of the impellers 302 and 304 may include a number of blades 308 configured such that as the impeller rotates, water is moved from the input port 306 toward the output nozzle 318, e.g., along the illustrative flow path generally indicated at 310. In embodiments, the impellers 302 and 304 (and blades 308) may be configured according to any number of impeller designs, including designs that are generally similar to the design of Pelton wheels, as shown in FIGS. 8-13. Additionally, in embodiments, the blades 308 may be configured to optimize propulsion in view of various factors such as, for example, vessel weight, vessel configuration, water depth, average water temperatures, cavitation thresholds, and/or the like.

FIGS. 14-19 depict another illustrative marine propulsion system 400 in accordance with embodiments of the disclosure. The marine propulsion system 400 includes generally similar features and components as those in the marine propulsion systems 100 and 200 depicted in FIGS. 2-7 and 8-13, respectively, with the exception of the design of the impellers 402, 404, 406, and 408, and the locations of the input ports 410 and 412. As shown in FIGS. 14-19, the system 400 may include two pairs of impellers 402, 404 and 406, 408. Each pair of impellers may include a first impeller 402, 406 that is a centrifugal impeller having blades 414 configured so as to move water from the bottom 416 of the system 400 to the rear 418 of the system 400, and a second impeller 404, 408 that may be designed to be similar to a Pelton wheel, having a shorter profile and blades 420 designed for moving water from the front 422 of the system 400 to the rear 418 of the system 400.

For example, the marine propulsion system 400 may be, or include, the marine propulsion system 102 depicted in FIG. 1 and may be configured to be coupled to a vessel (e.g., the vessel 100 depicted in FIG. 1). As shown in FIGS. 14-19, the marine propulsion system 400 includes a housing 424 and an output nozzle 426 coupled to the rear portion 418 of the housing 424. The output nozzle 426 may be moveably (e.g., pivotably) coupled to the housing 424. In this manner, the output nozzle 426 may be used for steering and/or other positional control of a vessel to which it is attached. One or more winglets or other features may be disposed on the outside of the output nozzle 426 to further achieve hydrodynamic objectives.

Figure 14:
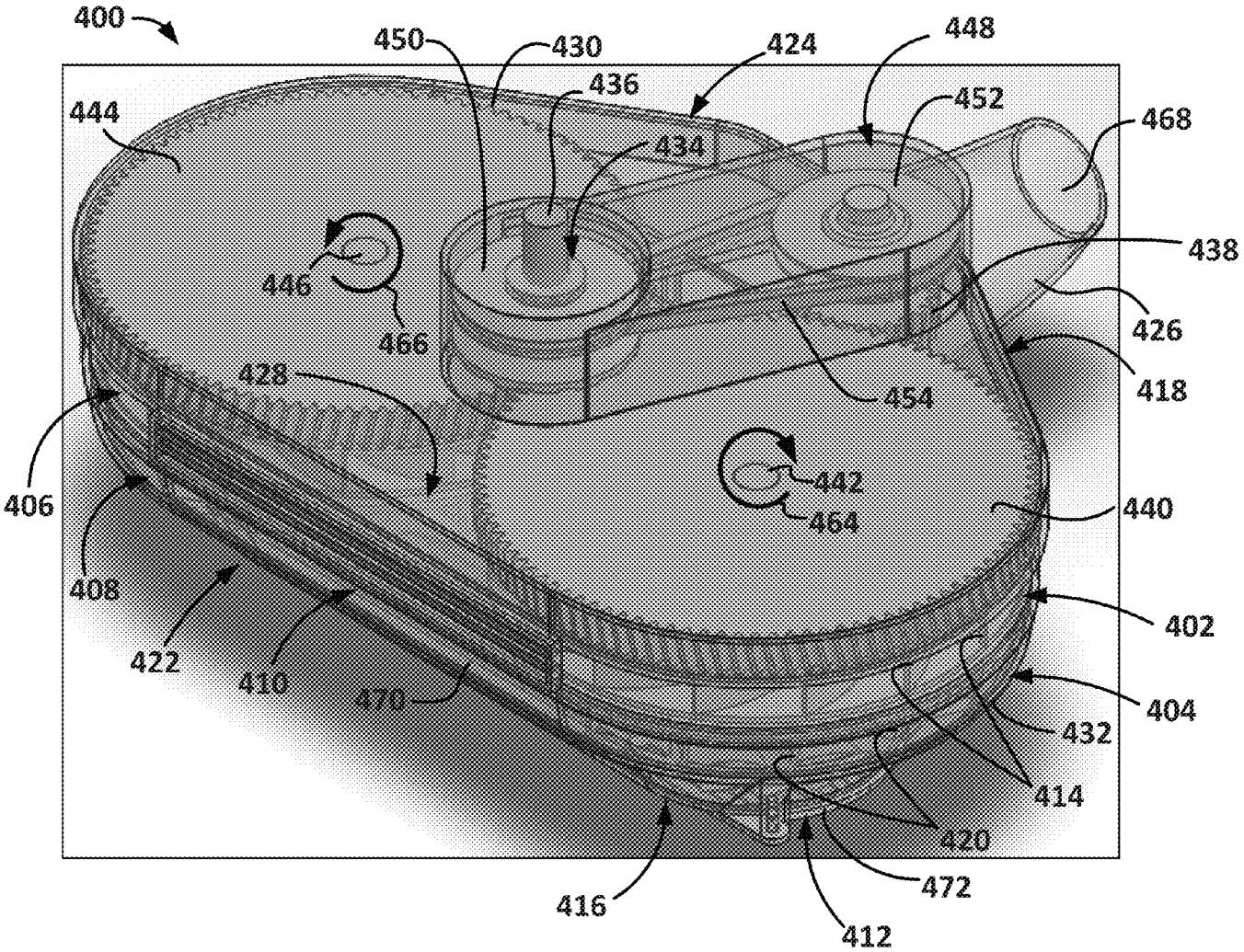
FIG. 14 is a partially-transparent upper perspective view of another marine propulsion system in accordance with an exemplary third embodiment of the present disclosure.
Figure 16:
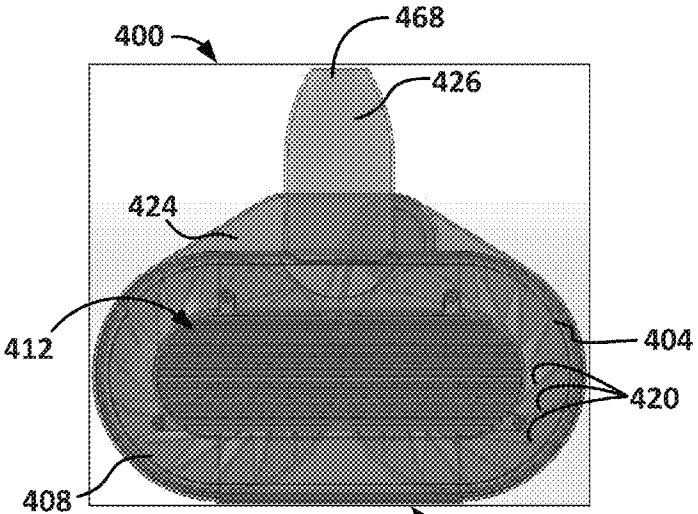
FIG. 16 is a partially-transparent bottom view of the marine propulsion system depicted in FIGS. 14 and 15.
Figure 15:
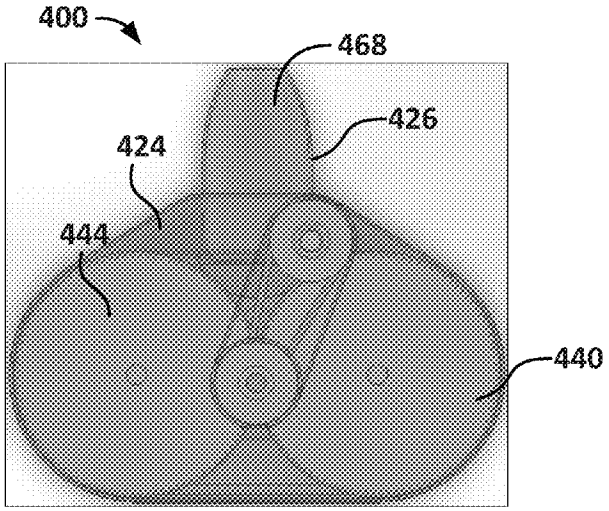
FIG. 15 is a partially-transparent top view of the marine propulsion system depicted in FIG. 14.
Figure 17:
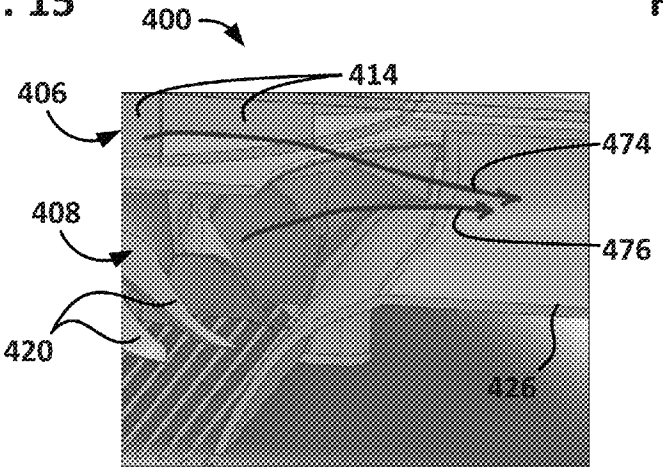
FIG. 17 is a perspective view of a portion of the marine propulsion system depicted in FIGS. 14-16.
Figure 18:
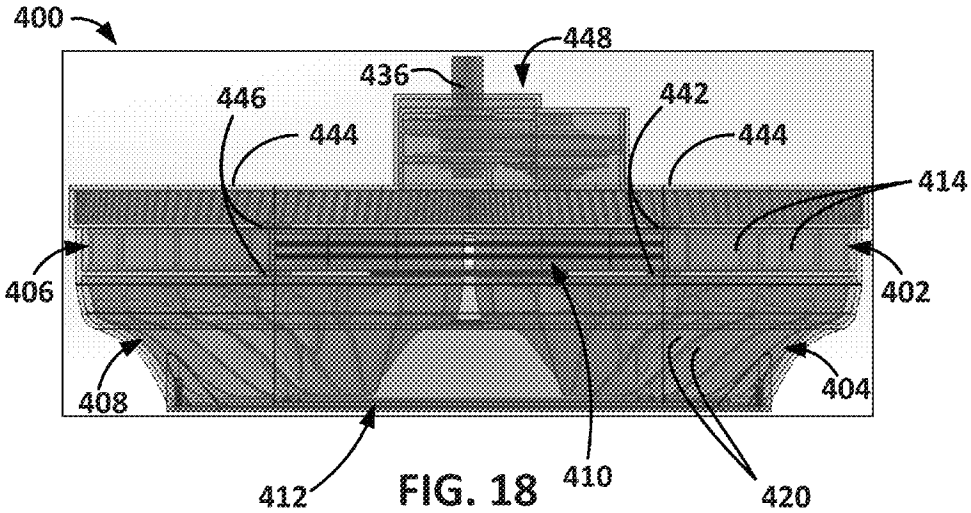
FIG. 18 is a partially-transparent front view of the marine propulsion system depicted in FIGS. 14-17.

The housing 424 may enclose a chamber 428, and generally includes an upper surface 430, a generally parallel and opposite-facing lower surface 432, the front portion 422, and the rear portion 418. The upper surface 430 may include attachment features (not shown) for coupling the housing 424 to a hull of a vessel, and attachment features may be included on other portions of the housing 424 such as, for example, for coupling the housing 424 within a portion of a hull. As shown in FIG. 14, the upper surface 430 of the housing 424 may include an aperture 434 through which a drive shaft 436 may pass. As shown in FIG. 14, the drive shaft 436 may be coupled to one or more drive gears 438, which may engage a first impeller gear 440 that is coupled to the first impeller 402 and (either directly or indirectly) the second impeller 404 via a gear shaft 442. The first impeller gear 440 may also be configured to engage a second impeller gear 444 that is coupled to the third impeller 406 and (either directly or indirectly) the fourth impeller 408 via a gear shaft 446. In embodiments, The system 400 may include a continuous variable transmission (CVT) 448, as illustrated in FIGS. 14-19. Additionally, the systems 200 and/or 300 may include a CVT similar to the CVT 448 depicted in FIGS. 14-19.

Figure 19:
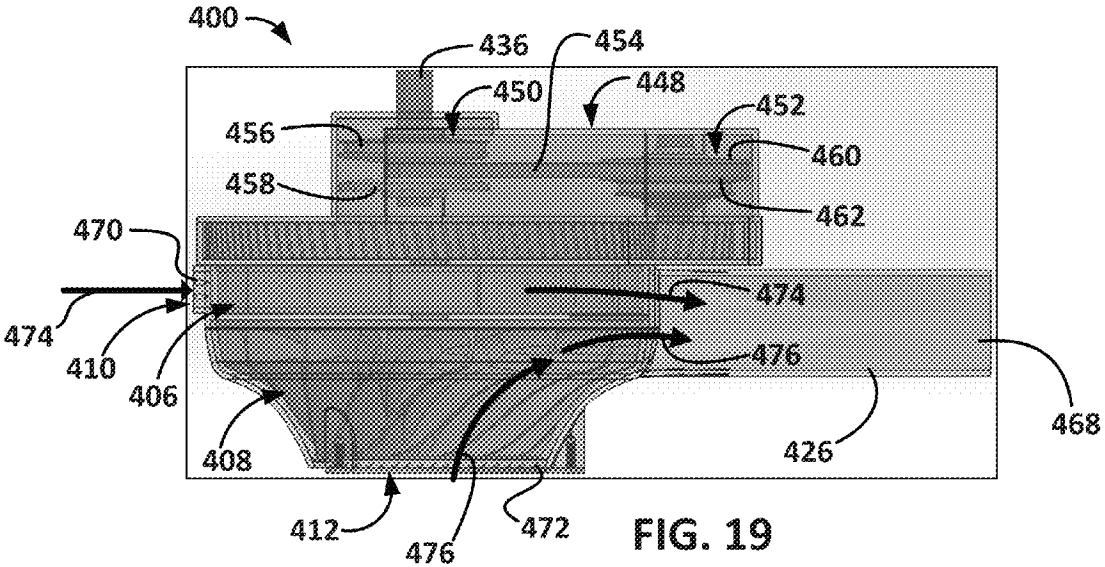
FIG. 19 is a partially-transparent side view of the marine propulsion system depicted in FIGS. 14-18.

As illustrated, the CVT 448 may include a drive pulley 450, coupled to the drive shaft 436, and a driven pulley 452 that engages the drive gear 438, with a v-belt 454 extending between the pulleys 450 and 452. The gear ratio may be changed, as with conventional CVT systems, by adjusting the effective diameters of the pulleys 452 and 454. That is, for example, as shown in FIG. 19, the drive pulley 450 may include a first sheave 456 and a second sheave 458, and the driven pulley 454 may include a first sheave 460 and a second sheave 462. The sheaves 456 and 458 of the drive pulley 450 can be moved closer together as the sheaves 460 and 462 are moved farther apart, and vice-versa, thereby changing the effective diameter of the pulleys 452 and 454 and, thus, the gear ratio.

In this manner, the first and second impellers 402 and 404 may be configured to rotate in a clockwise direction 464, which causes the third and fourth impellers 406 and 408 to rotate in a counterclockwise direction 466. The counter-rotating impellers 402, 404 and 406, 408 pull water in through the input ports 410 and 412 disposed on the front portion 422 and bottom portion 416 of the housing 424, respectively, and push water out of the nozzle 426, through an opening 468 disposed therein. A grate 470 (or other protective covering such as, for example, a screen) may be disposed over the input port 410 to prevent objects from entering the chamber 428 and causing damage to, and/or being damaged by, the impellers 402, 404, 406, and 408 and/or other parts within the housing 428. Similarly, a grate 472 (or other protective covering such as, for example, a screen) may be disposed over the input port 412.

Each of the impellers 402 and 406 may include a number of blades 414 configured such that as the impeller rotates, water is moved from the input port 410 toward the output nozzle 426, e.g., along the illustrative first flow path generally indicated at 474, which is substantially parallel to the surface of the water. In embodiments, the impellers 402 and 406 (and blades 414) may be configured according to any number of impeller designs, including designs that are generally similar to the design of Pelton wheels, as shown in FIGS. 14-19. Similarly, each of the impellers 404 and 408 may include a number of blades 420 configured such that as the impeller spins, water is moved from the input port 412 toward the output nozzle 426, e.g., along the second illustrative flow path generally indicated at 476, which curves from an input direction substantially perpendicular to the surface of the water proximate input port 412 upon entry into the impellers 404 and 408 to an output direction substantially parallel to the surface of the water upon exiting the impellers 404 and 408. Further, as may be seen in FIG. 19, first and second flow paths 474 and 476 merge with one another within output nozzle 426 at the exits from their respective impellers 402, 406 and 404, 408. The impellers 404 and 408 (and blades 420) may be configured according to any number of impeller designs, including centrifugal impeller designs, as shown in FIGS. 14-19. Additionally, the blades 414 and 420 may be configured to optimize propulsion in view of various factors such as, for example, vessel weight, vessel configuration, water depth, average water temperatures, cavitation thresholds, and/or the like.

While embodiments of the present disclosure are described with specificity, the description itself is not intended to limit the scope of this patent. Thus, the inventors have contemplated that the claimed disclosure might also be embodied in other ways, to include different steps or features, or combinations of steps or features similar to the ones described in this document, in conjunction with other technologies.

The following is claimed:

1. A marine propulsion system, comprising:

a housing configured to be coupled to a marine vessel the housing including an inlet and an outlet;

a pair of counter-rotating impellers disposed within the housing, the impellers rotatable generally parallel to a water surface about respective rotation axes disposed generally perpendicular to the water surface to convey water from the inlet and through the outlet to provide thrust to the vessel, each impeller including at least three curved blades; and at least one of an engine and a motor drivingly coupled to the marine propulsion system, and wherein the thrust comprises at least one of forward thrust and reverse thrust.

2. The marine propulsion system of claim 1, wherein the outlet includes an output nozzle, the output nozzle having an opening out of which water is pushed by the impellers to provide the thrust, wherein the output nozzle is moveable, thereby facilitating steering control and/or vessel trim control.

3. The marine propulsion system of claim 2, wherein the inlet is disposed on a bottom portion of the system, and the impellers are configured to draw water into the system through the inlet, and centrifugally propel the water into the movable nozzle.

4. The marine propulsion system of claim 2, wherein the inlet is disposed on a front portion of the system, and the impellers are configured to draw water into the system through the inlet, and centrifugally propel the water into the movable nozzle.

5. The marine propulsion system of claim 2, further comprising an additional pair of impellers, wherein the pair of impellers is configured to draw water into the system through a first inlet disposed on a bottom portion of the system, and centrifugally propel the water into the movable nozzle; and wherein the additional pair of impellers is configured to draw water into the system through a second inlet disposed on a front portion of the system, and propel the water into the movable nozzle.

6. The marine propulsion system of claim 1, further comprising a transmission system coupled to the impellers via a drive shaft, wherein the transmission system is configured to enable an operator to change the speed of the impellers in relation to the speed of the input shaft.

7. The marine propulsion system of claim 1, the housing comprising an upper surface and a lower surface, the upper and lower surfaces imparting a shape to the housing that is configured to provide hydrodynamic lift to assist the vessel in coming on plane and staying on plane.

8. The marine propulsion system of claim 1, further comprising one or more external control surfaces configured to assist in at least one of steering the vessel and adjusting a trim of the vessel.

9. The marine propulsion system of claim 8, wherein the external control surface comprises at least one winglet disposed on a first side of the housing and at least one winglet disposed on a second side of the housing.

10. A marine vessel, comprising:

a hull;

a marine propulsion system including a housing connected directly to the hull, the housing including an inlet and an outlet and a pair of counter-rotating impellers disposed within the housing that rotate generally parallel to a water surface about respective rotation axes disposed generally perpendicular to the water surface to convey water from the inlet and through the outlet to provide thrust to the vessel, each impeller disposed within the housing and including of at least three curved blades; and at least one of an engine and a motor drivingly coupled to the marine propulsion system, and wherein the thrust comprises at least one of forward thrust and reverse thrust.

11. The marine vessel of claim 10, further comprising at least one additional marine propulsion system.

12. The marine vessel of claim 10, wherein the marine propulsion system is integrated into the hull.

13. The marine vessel of claim 10, wherein the outlet includes an output nozzle, the output nozzle having an opening out of which water is pushed by the impellers to provide the thrust, wherein the output nozzle is moveable, thereby facilitating steering control and/or vessel trim control.

14. The marine vessel of claim 13, wherein the inlet is disposed on a bottom portion of the system, and the impellers are configured to draw water into the system through the inlet, and centrifugally propel the water into the movable nozzle.

15. The marine vessel of claim 13, wherein the inlet is disposed on a front portion of the system, and the impellers are configured to draw water into the system through the inlet, and centrifugally propel the water into the movable nozzle.

16. The marine vessel of claim 15, further comprising an additional pair of impellers, wherein the pair of impellers is configured to draw water into the system through a first inlet disposed on a bottom portion of the system, and centrifugally propel the water into the movable nozzle; and wherein the additional pair of impellers is configured to draw water into the system through a second inlet disposed on a front portion of the system, and propel the water into the movable nozzle.

17. A marine propulsion system, comprising:

a housing configured to be coupled to a marine vessel, the housing including an inlet and an outlet and at least one surface imparting a shape to the housing that is configured to provide hydrodynamic lift to assist the vessel in coming on plane and staying on plane;

a pair of counter-rotating impellers disposed within the housing that rotate generally parallel to a water surface to convey water from the inlet and through the outlet to provide thrust to the vessel, each impeller including at least three curved blades;

at least one of an engine and a motor drivingly coupled to the marine propulsion system, and wherein the thrust comprises at least one of forward thrust and reverse thrust; and the outlet including an output nozzle, the output nozzle having an opening out of which water is pushed by the impellers to provide the thrust, wherein the output nozzle is moveable, thereby facilitating steering control and/or vessel trim control.

18. The marine propulsion system of claim 1, wherein the impellers are in driving engagement with each other.

19. The marine vessel of claim 10, wherein the impellers are in driving engagement with each other.

20. The marine propulsion system of claim 17, wherein the impellers are in driving engagement with each other.

* * * * *